United States Patent [19]

Smith et al.

[11] 4,120,106

[45] Oct. 17, 1978

[54] SIDEBANK EXCAVATOR WITH ROTATING VERTICAL CUTTER ASSEMBLY

[75] Inventors: Donald Wayne Smith, Edmond; George W. Swisher, Jr., Oklahoma City; Larry W. Teel, Yukon, all of Okla.

[73] Assignee: CMI Corporation, Oklahoma City, Okla.

[21] Appl. No.: 787,629

[22] Filed: Apr. 14, 1977

[51] Int. Cl.[2] ..... E02F 3/24; B65G 57/00

[52] U.S. Cl. ..... 37/190; 37/110; 198/518; 214/10

[58] Field of Search ..... 37/110, 189, 190; 214/10; 198/518, 519; 175/383

[56] References Cited

U.S. PATENT DOCUMENTS

| | | | |
|---|---|---|---|
| 1,055,548 | 3/1913 | McChesney | 37/189 |
| 1,436,015 | 11/1922 | Cushing | 37/67 |
| 1,730,958 | 10/1929 | Van Wienen | 37/67 |
| 1,790,810 | 2/1931 | Haiss | 37/190 |
| 1,974,190 | 9/1934 | Miller | 37/190 |
| 3,382,002 | 5/1968 | Tabor | 37/189 X |
| 3,500,988 | 3/1970 | Smith | 37/109 X |
| 3,612,246 | 10/1971 | Elze et al. | 37/190 X |
| 3,916,544 | 11/1975 | Swisher, Jr. et al. | 37/110 |
| 4,009,531 | 3/1977 | Metrier | 37/190 X |

FOREIGN PATENT DOCUMENTS

| | | | |
|---|---|---|---|
| 1,116,428 | 6/1968 | United Kingdom | 37/190 |
| 188,360 | 11/1966 | U.S.S.R. | 37/189 |

*Primary Examiner*—Clifford D. Crowder
*Attorney, Agent, or Firm*—Dunlap, Codding & McCarthy

[57] ABSTRACT

An improved sidebank excavator for removing earth from the side of a hill or other embankment, the excavator having a fixed, bidirectional horizontal earth removal assembly; a rotating, bidirectional vertical earth removal assembly; a conveyor assembly for conveying particulate material deposited on a receiving portion thereof to a discharge portion thereof remote from the receiving portion; and a plurality of independently vertically adjustable track drive assemblies.

6 Claims, 8 Drawing Figures

SIDEBANK EXCAVATOR WITH ROTATING VERTICAL CUTTER ASSEMBLY

CROSS REFERENCE TO RELATED APPLICATIONS

The subject matter of the present patent application is related to the subject matter of U.S. patent application Ser. No. 142,725, entitled "Sidebank Excavator", filed May 12, 1971, now U.S. Pat. No. 3,778,912; U.S. patent application Ser. No. 398,839, entitled "Excavator, Conveyor and Conveyor Control Apparatus", filed Sept. 20, 1973, now U.S. Pat. No. 3,897,640; and U.S. patent application Ser. No. 398,840, entitled "sidebank Excavator With Grade and Slope Control", filed Sept. 20, 1973, now U.S. Pat. No. 3,916,554, all of which are assigned to the assignee of the present invention.

BACKGROUND OF THE INVENTION

1. Field of the Invention

This invention relates generally to improvements in sidebank excavators and, more particularly, but not by way of limitation, to a sidebank excavator having a rotary vertical cutting assembly.

2. Description of the Prior Art

A general description of the prior art relating to sidebank excavators may be found in the U.S. Pat. Nos. 3,778,912; 3,897,640 and 3,916,554. In such apparatus, it is not unusual to combine a horizontally oriented cutting assembly with a vertically oriented cutting assembly to provide for a notching effect of an embankment or the like. In such configurations, it is most commonly taught to construct the horizontal and vertical cutting assemblies as fixed cutting edges which act similar to a plow when forced into and along an embankment. However, even in the ingenius bidirectional configuration taught in the U.S. Pat. No. 3,778,912, vast amounts of energy are devoted to moving the vertical cutter assembly by brute force along the embankment.

As can be seen in such apparatus as that shown in U.S. Pat. No. 3,802,525, the use of rotary cutting assemblies in horizontal configurations is well known in the road construction art. However, even in view of the power conserving characteristics of rotary cutters, it has not heretofore been generally proposed to equip sidebank excavators with rotary vertical cutting assemblies. Much less has it been proposed to provide such rotary vertical cutting assemblies with bidirectional cutters to further improve upon the decided operational advantages inherent in the bidirectional design embodied in the excavator taught in U.S. Pat. No. 3,778,912.

SUMMARY OF THE INVENTION

The present invention contemplates a sidebank excavator having a fixed horizontal cutting assembly and a rotary vertical cutting assembly.

An object of the present invention is to greatly increase the efficiency of sidebank excavators thorugh the use of a rotary vertical cutting assembly.

Another object of the present invention is to provide an improved rotary cutting assembly having bidirectional cutters which facilitate efficient operation of a cutter assembly in either of two opposite rotary directions.

Yet another object of the present invention is to provide an improved bidirectional pivoting cutter for use with rotary vertical cutting assemblies, the cutters having a pair of cutting surfaces disposed so that only one of the pair will engage an adjacent embankment upon rotation of the cutter assembly in either of two opposite rotary directions.

Still another object of the present invention is to provide a rotary vertical cutting assembly provided with a plurality of cutters having replaceable earth engaging portions.

A further object of the present invention is to provide a sidebank excavator having a rotary vertical cutting assembly which is particularly efficient in operation and which may be easily and economically manufactured and maintained even under field conditions.

Other objects and advantages of the present invention will be evident from the following detailed description when read in conjunction with the accompanying drawings which illustrate various embodiments of the invention.

DESCRIPTION OF THE PREFERRED EMBODIMENT

Figure 1:
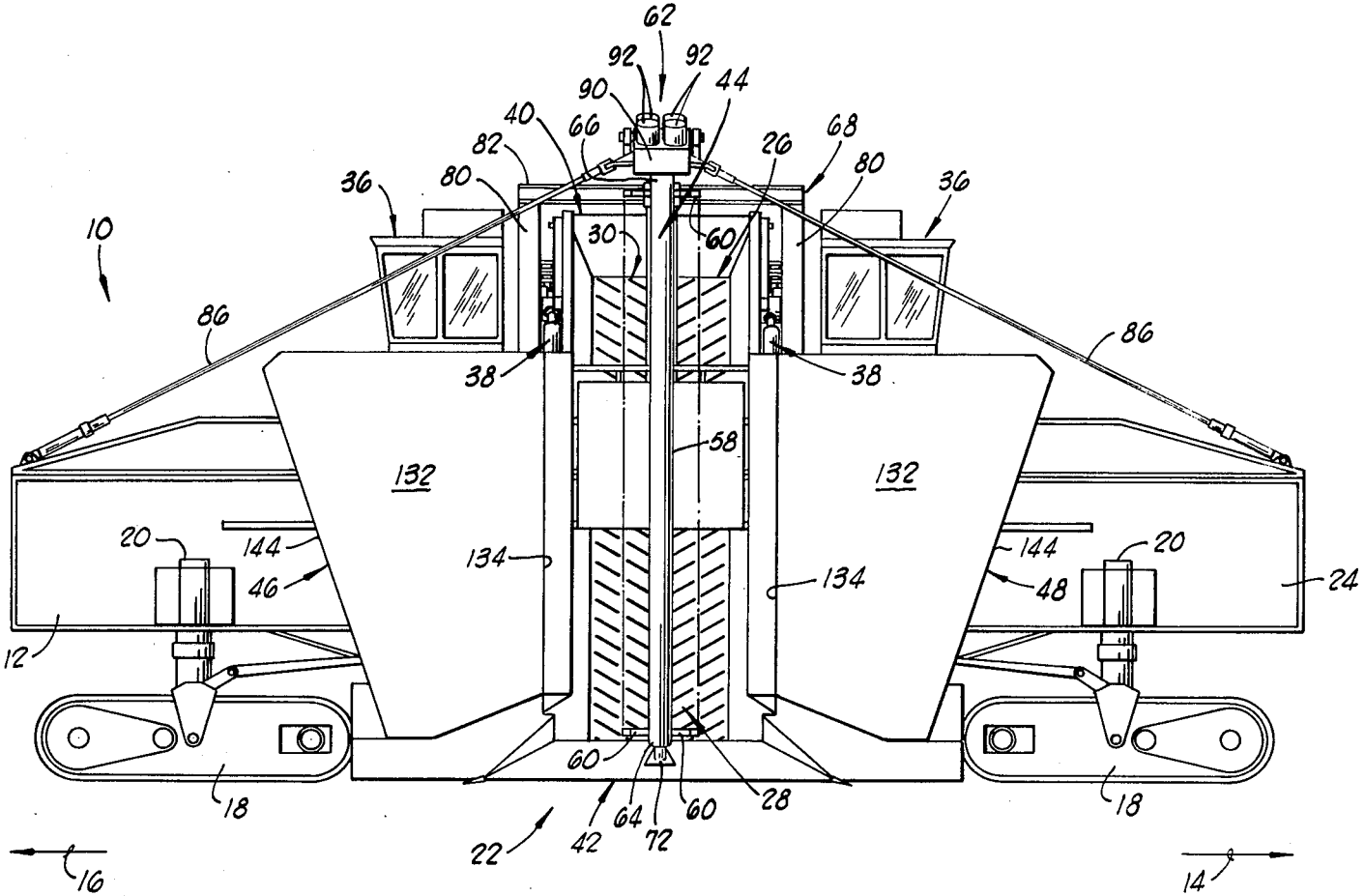
FIG. 1 is a side elevational view of a sidebank excavator constructed in accordance with the present invention.
Figure 2:
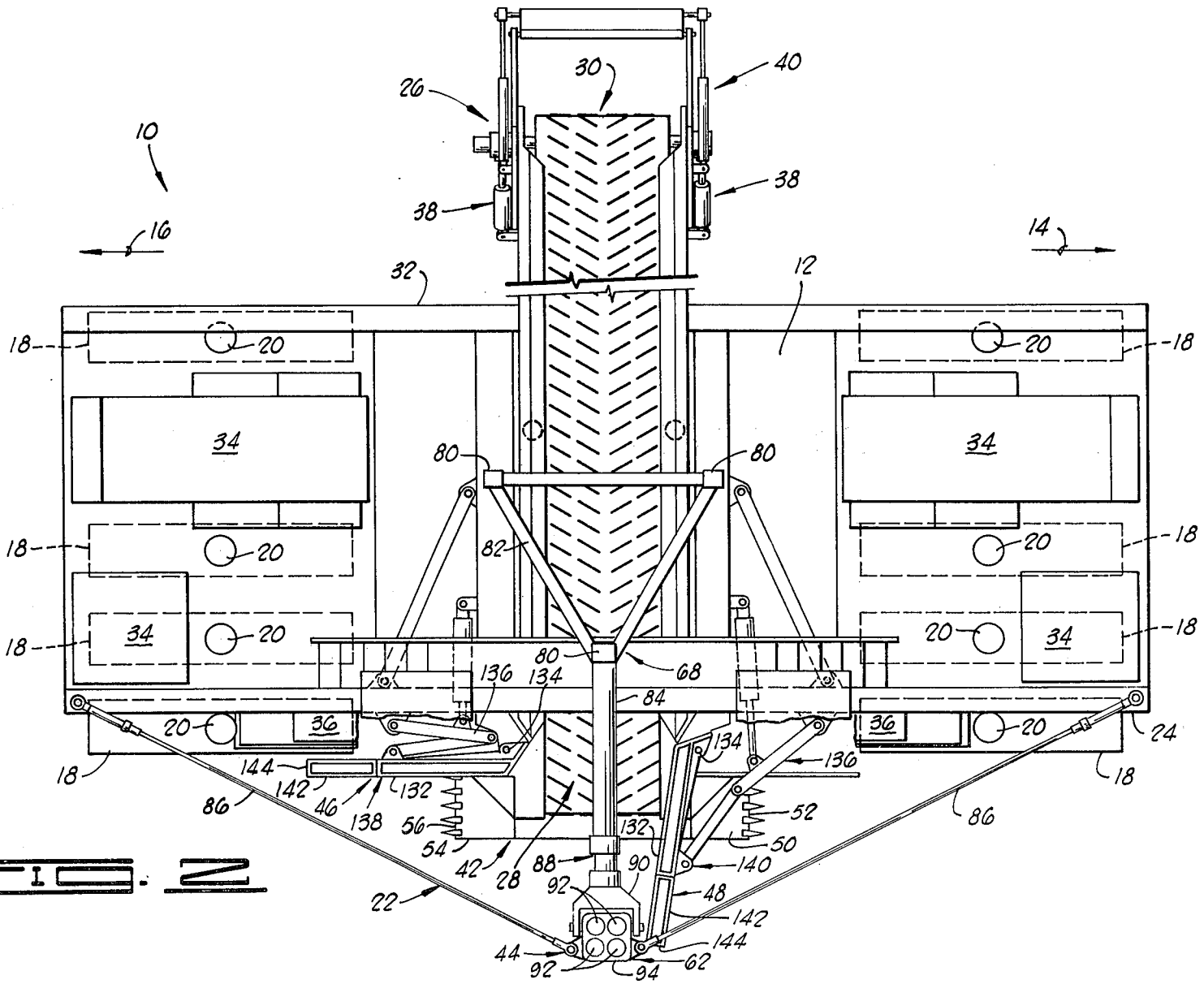
FIG. 2 is a top plan view of the excavator of FIG. 1.
Figure 3:
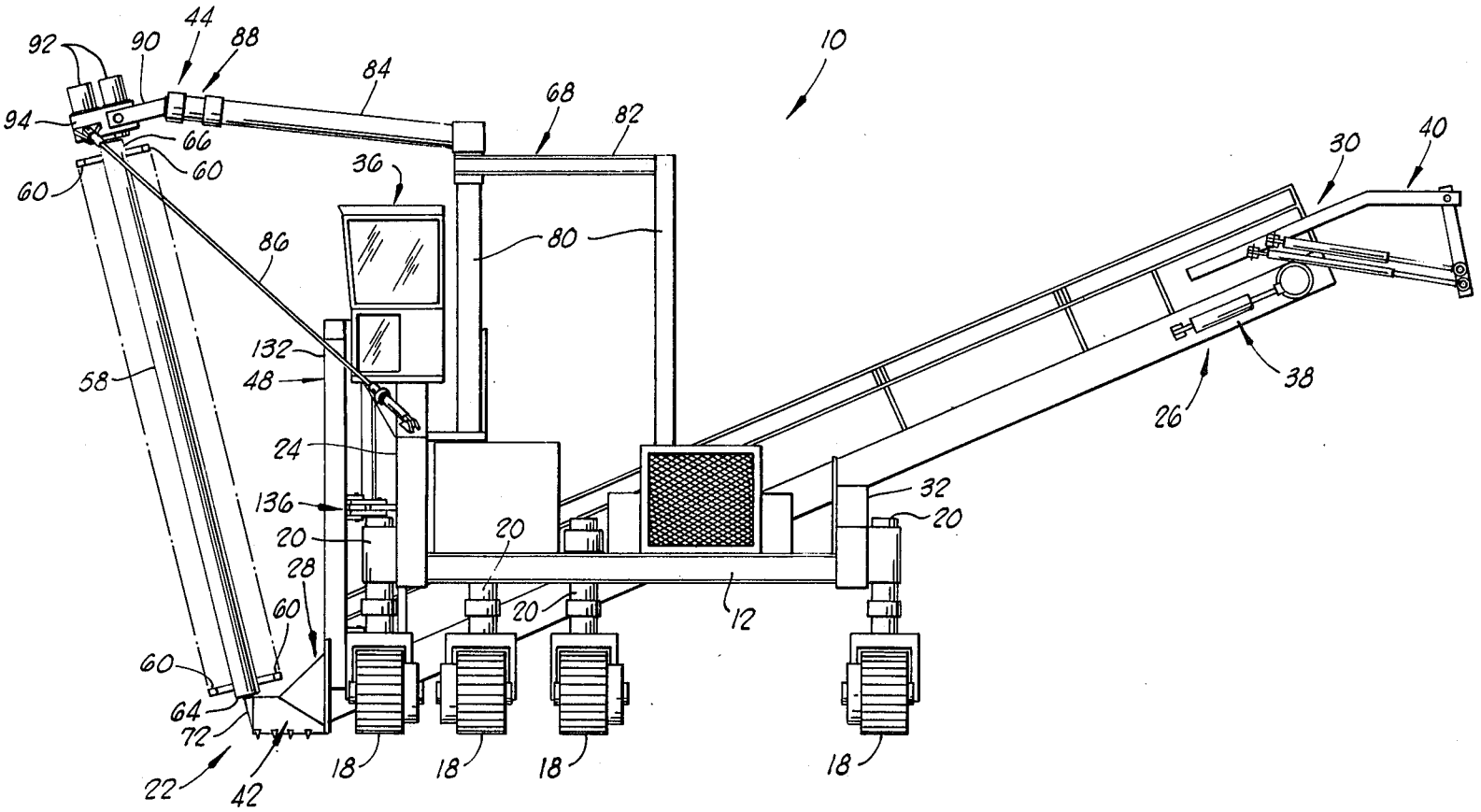
FIG. 3 is an elevational view of one end of the excavator of FIG. 1.

Referring to the drawings in general, and to FIGS. 1, 2 and 3 in particular, shown therein and designated by the general reference number 10 is a sidebank excavator constructed in accordance with the preferred embodiment of the present invention. The excavator 10 is comprised primarily of a frame 12 which is supported for movement in a first direction 14 and in a second direction 16 opposite to the first direction 14 by a plurality of conventional track drive assemblies 18, each of which is independently vertically adjustable relative to the frame 12 via a double acting hydraulic ram 20; an earth cutting assembly 22 connected to the frame 12 on a cutting side 24 thereof; a conveyor assembly 26 connected to the frame 12 substantially transversely thereto with a receiving portion 28 of the conveyor assembly 26 positioned adjacent the earth cutting assembly 22 and a discharge portion 30 thereof extending outwardly from a discharge side 32 of the frame 12; and a plurality of power units 34 of conventional construction for providing power to the track drive assemblies 18, the conveyor assembly 26, and the earth cutting assembly 22.

The excavator 10 is constructed substantially the same as the escavator shown and described in great detail in U.S. patent application Ser. No. 142,725, entitled "Sidebank Excavator", filed May 12, 1971, now U.S. Pat. No. 3,778,912. However, the excavator 10 has been provided with a pair of operator enclosures 36 to protect the operator from adverse environmental conditions. In view of the great similarity between the excavator 10 and the excavator disclosed in U.S. Pat. No. 3,778,912, detailed references will be made to the construction details of the excavator 10 only when needed to fully describe the construction and operation of the present invention.

Although the excavator 10 may be operated in a manual mode if desired, it has been determined that the excavator 10 may be operated most efficiently by using an automatic grade and slope control system such as that disclosed in U.S. patent application Ser. No. 398,840, entitled "Sidebank Excavator with Grade and Slope Control", filed Sept. 20, 1973, now U.S. Pat. No. 3,916,544. In view of the detailed disclosure of the construction and operation of such grade and slope control system which is readily available in U.S. Pat. No. 3,916,544, detailed description of and reference to the components of such a system will be made herein only when helpful in describing the construction and operation of the present invention.

The conveyor assembly 26, including a conveyor belt tensioning assembly 38 at the discharge end 30 thereof, is constructed substantially the same as the conveyor assembly shown and described in detail in U.S. patent application Ser. No. 398,839, entitled "Excavator, Conveyor and Conveyor Control Apparatus", filed Sept. 20, 1973, now U.S. Pat. No. 3,897,640. However, the conveyor assembly 26 is provided with a discharge deflector assembly 40 connected to the discharge end 30 thereof to greatly facilitate continuous operation of the excavator 10 by enabling the stream of particulate material being discharged from the conveyor assembly 26 to be rapidly and conveniently directed between a pair of material transport vehicles (not shown) being driven in parallel alongside the discharge side 32 of the excavator 10. Since the operation and advantages of the deflector assembly will be clear to those skilled in the art, and reference may be made to U.S. Pat. No. 3,897,640, for a full description of the construction and operation of the conveyor assembly 26, no further reference to the detailed construction of the conveyor assembly 26 will be made herein except when desirable to facilitate description of the present invention.

The earth cutting assembly 22 is comprised primarily of a horizontal earth removal assembly 42, a vertical earth removal assembly 44, and a pair of earth containment extensions 46 and 48. The horizontal earth removal assembly 42, which is connected to the medial portion of the cutting side 24 of the frame 12, includes a first portion 50 which is constructed and disposed to excavate earth from an adjacent enbankment generally along a horizontal plane defined by a cutting edge 52 when moved in the first direction 14; and a second portion 54 which is constructed and disposed to excavate earth from the adjacent embankment along a horizontal plane defined by a cutting edge 56 when moved in the second direction 16. Since the horizontal earth removal assembly 42 is constructed substantially the same as the horizontal earth removal assembly shown and described in great detail in U.S. Pat. No. 3,778,912, no further reference will be made herein to the details of construction thereof.

Figure 7:
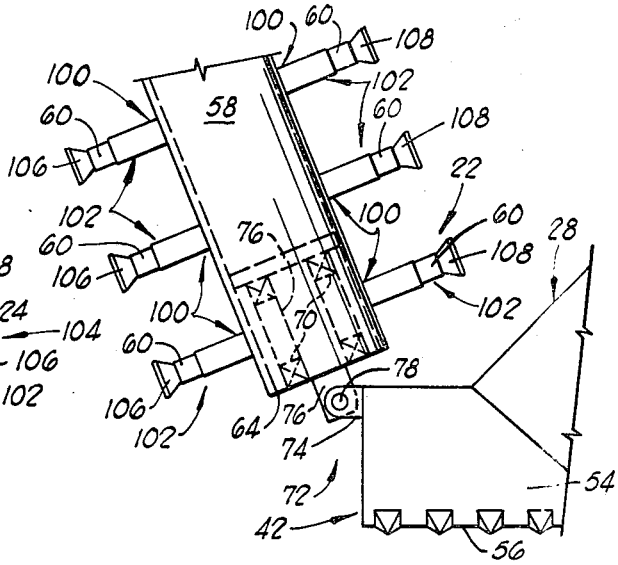
FIG. 7 is a partial view of the vertical and horizontal cutting assemblies of the excavator of FIG. 1.

The vertical earth removal assembly 44 is comprised primarily of an elongated cutter support assembly 58, a plurality of cutters 60 connected to the periphery of the cutter support assembly 58 at spaced intervals along the length thereof (only a few of the cutters 60 being shown in FIGS. 1–3 for purposes of clarity), and a power assembly 62 for rotating the cutting support assembly 58 about the longitudinal axis thereof. The cutter support assembly 58 has a lower end 64 connected to the excavator 10 adjacent the receiving portion 28 of the conveyor assembly 26 for rotation about the longitudinal axis of the cutter support assembly 58; and an upper end 66 connected to the excavator 10 via a support arm assembly 68 with the longitudinal axis of the cutter support assembly 58 extending generally upwardly from the excavator 10. As shown in FIG. 7, the lower end 64 of the cutter support assembly 58 is preferably journalled via bearings 70 on a stud 72 extending upwardly from the outermost, medial portion of the horizontal earth removal assembly 42. Preferably, the stud 72 is comprised of a pair of lugs 74 connected as by welding to the excavator 10; and a stem portion 76 connected to the cutter support assembly 58 via the bearings 70 and to the lugs 74 via a removable pin 78, thereby facilitating removal and angular adjustment of the vertical earth removal assembly 44.

In the preferred embodiment, the support arm assembly 68 includes a plurality of vertical support members 80, a triangular frame 82 connecting the upper portions of the vertical members 80, and a boom 84 extending outwardly from the triangular frame 82 over the horizontal earth removal assembly 42. A pair of adjustable braces 86 extend between the upper end 66 of the cutter support assembly 58 and remote portions of the frame 12 to add strength to the support arm assembly 68. If desired, the boom 84 may be provided with a double acting hydraulic ram portion 88 to facilitate retraction of the bifurcated cutter support yoke 90 forming the outer end thereof, for transport of the excavator 10 between excavation sites.

As will be clear to those skilled in the art, the angle of inclination of the vertical earth removal assembly 58 from the vertical may be easily varied to provide for differences in the self-supporting characteristics of various, naturally occurring embankments, by changing the length of the boom 84. However, it has been determined that an angle of inclination of approximately 15 degrees is particularly advantageous for excavating embankments composed of relatively small diameter, firmly packed particulate material such as natural soil deposits.

The upper end 66 of the cutter support assembly 58 is connected to one or more fluid motors 92 via a chain or gear transmission 94, with the transmission 94 being supported in a conventional manner by the cutter support yoke 90. Upon actuation thereof, the motors 92 cooperate with the transmission 94 to rotate the cutter support assembly 58 in a first rotary direction 96 to bring the cutters 60 into engagement with the adjacent embankment when the excavator 10 is moving in the first direction 14. In the bidirection configuration of the preferred embodiment, the motors 92 may also be actuated to rotate the cutter support assembly 58 in a second rotary direction 98 for use when the excavator 10 is moving in the second direction 16. Although any desired number of motors 92 may be used, it has been determined that a four motor 92 configuration, such as that shown in FIGS. 1 through 3, is desirable when excavating highly cohesive materials such as coal; while a two motor 92 configuration, such as that shown in FIG. 8, is satisfactory for excavating soil and the like.

Figure 8:
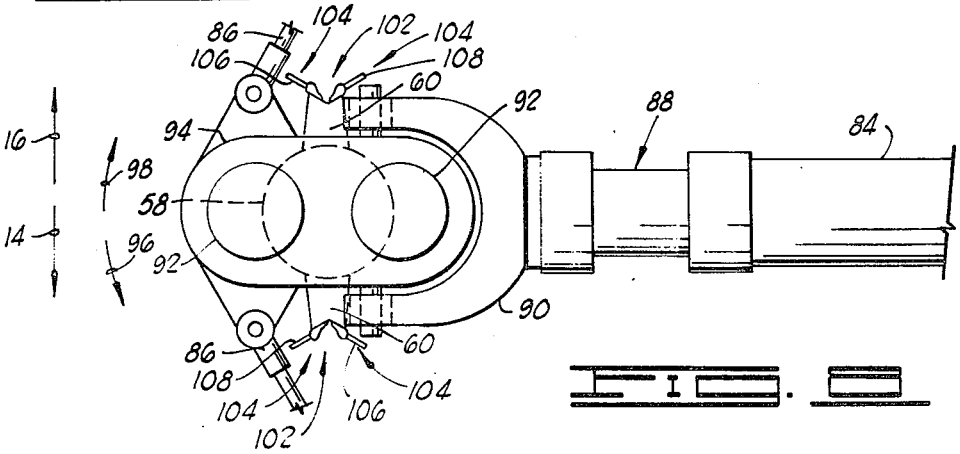
FIG. 8 is a partial top plan view of an alternate form of a vertical cutter assembly of the excavator of FIG. 1.

As can be seen most clearly in FIGS. 7 and 8, each of the cutters 60 has an inner end 100 connected to the periphery of the cutter support assembly 58, and an outer end 102 disposed radially outwardly of the inner end 100 thereof relative to the axis of the cutter support assembly 58. Although each of the cutters 60 may be connected at spaced intervals along the cutter support assembly 58 in vertically aligned rows, it has been determined that connecting the cutters 60 to the cutter support assembly 58 in a helical or spiral pattern results in better power utilization as a result of spreading the drag produced by the movement of the cutters 60 through the material of the adjacent embankment throughout the rotational period of the cutter assembly 58.

Each of the cutters 60 has at least one earth engaging portion 104 extending generally outwardly from the outer end 102 thereof relative to the axis of the cutter support assembly 58. More particularly, in the bidirectional configuration employed on the excavator 10, each of the cutters 60 has a first tooth 106 extending outwardly from the outer end 102 of the cutter 60 generally orthogonal to the axes of the cutter 60 and the cutter support assembly 58; and a second tooth 108 also extending outwardly from the outer end 102 of the cutter 60 generally orthogonal to the axes of the cutter 60 and the cutter support assembly 58, but substantially opposite to the first tooth 106. Thus, upon rotation of the cutter support assembly 58 as the excavator 10 is moved parallel to an adjacent embankment, the first or second tooth 106 or 108, respectively, will act to remove substantially all of the material of the embankment lying between the excavator 10 and a cutting plane lying substantially parallel to the excavator 10 but inclined at the angle of inclination of the cutter support assembly 58 and horizontally offset by the maximum perpendicular distance between the cutting side 24 and the first or second tooth 106 or 108, respectively, as appropriate.

Figure 4:
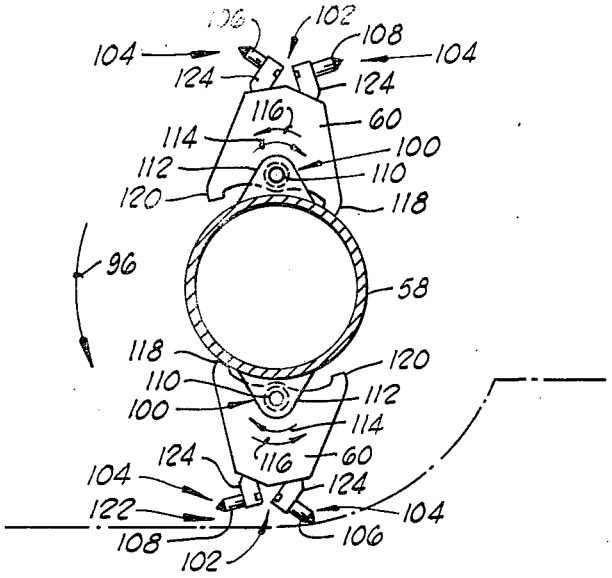
FIG. 4 is a cross sectional view of the vertical cutter assembly of the excavator of FIG. 1 showing one embodiment of the present invention.

Since a "trailing" tooth (108 or 106) will not normally follow the same path as a "leading" tooth (106 or 108) due to the simultaneous transverse movement of the excavator 10 in either the first or second directions 14 and 16, respectively, the "trailing" tooth (106 or 108) will tend to "drag" rather than "cut" through the material of the embankment lying ahead in the direction of transverse movement. Although the earth engaging portion 104 of the cutter 60 may theoretically be constructed to have one or more fixed cutting edges which are equally as efficient (or more likely inefficient) in operation in either "leading" or "trailing" modes, it has been determined to be most advantageous to construct the cutter 60 so that the path of movement of the "trailing" cutting edge lies largely within the swath cut in the embankment by the passage of the "leading" cutting edge therethrough. In one preferred form shown in FIG. 4, this objective may be achieved by pivotally connecting the inner end 100 of each of the cutters 60 to the cutter support assembly 58, as by a pivot pin 110 connected between a pair of lugs 112 with the axis of the pivot pin 110 being parallel to, but offset by slightly more than the radius of the cutter support assembly 58 from, the longitudinal axis thereof. Thus, upon rotation of the cutter support assembly 58 in the first rotary direction 96, the cutter 60 is free to rotate about the inner end 100 thereof in a first pivotal direction 114 to decrease the radial distance between the second tooth 108 and the cutter support assembly 58 relative to the radial distance between the first tooth 106 and the cutter support assembly 58; while, upon rotation of the cutter support assembly 58 in the second rotary direction 98, the cutter 60 is free to rotate in a second pivotal direction 116 opposite to the first pivotal direction 114 to decrease the radial distance between the first tooth 106 and the cutter support assembly 58 relative to the radial distance between the second tooth 108 and the cutter support assembly 58.

Preferably, the cutter 60 is provided with a first stop portion 118 extending generally in the first pivotal direction 114 from the cutter 60 adjacent the inner end 100 thereof to limit the rotation of the cutter 60 in the first pivotal direction 14 to a first predetermined distance, and a second stop portion 120 extending generally in the second pivotal direction 116 from the cutter 60 adjacent the inner end 100 thereof to limit the rotation of the cutter 60 in the second pivotal direction 116 to a second predetermined distance. The first and second predetermined distances, which are usually substantially equal, may be easily determined in a conventional manner from the operating speed of rotation of the cutter support assembly 58 and the maximum operating speed of the excavator 10 in the first or second directions 14 and 16, respectively. In the embodiment shown in FIG. 4, the cutters 60 are shown pivoted in the first pivotal direction 114 to bring the first stop portions 118 thereof into engagement with the adjacent portion of the cutter support assembly 58 to emphasize the clearance as at 122 between the "trailing" tooth 108 and the adjacent embankment shown in phantom. While each of the teeth 106 or 108 may be formed as an integral part of the respective cutter 60, it is preferred to provide the cutter 60 with tooth holders 124 of conventional construction so that the teeth 106 and 108 may be formed separately to facilitate easy removal and replacement. In such a form, the teeth 106 and 108 may be any of a variety of well known types.

Figure 5:
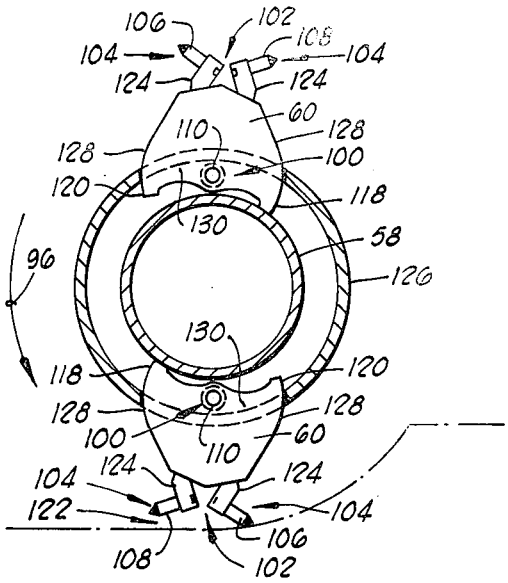
FIG. 5 is a cross sectional view of another form of the vertical cutter assembly of the excavator of FIG. 1 showing an alternate embodiment of the present invention.

In the embodiment of FIG. 5, a sleeve 126 is disposed coaxially around the cutter support assembly 58 to prevent the introduction of damaging particulate material into the pivotal connection between the cutters 60 and the cutter support assembly 58. In this embodiment, each of the cutters 60 is provided with arcuate edges 128 along the medial portion thereof and extends through an associated substantially rectangular-shaped arcuate slot 130 in the sleeve 126. If the dimensions of each slot 130 are sufficiently close to the corresponding dimensions of the associated cutter 60, or each slot 130 is provided with a resilient seal portion (not shown), the pivotal connection between the cutter 60 and the cutter support assembly 58 will be protected from substantially all of the potentially destructive particulate material normally associated with the operation of the excavator 10.

Figure 6:
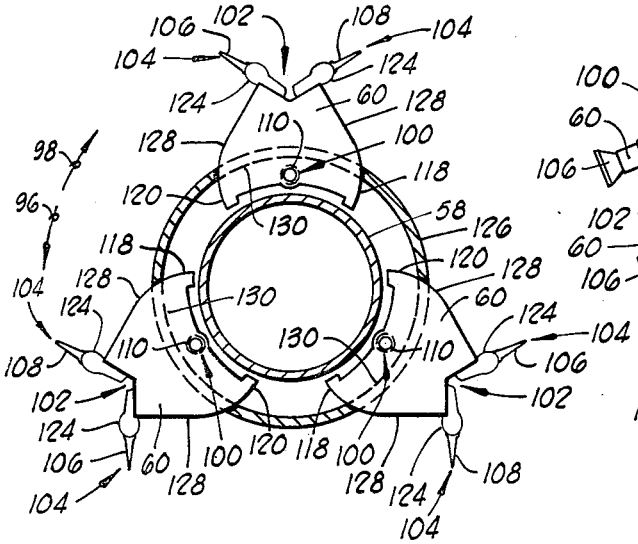
FIG. 6 is a cross sectional view of yet another form of the vertical cutter assembly of the excavator of FIG. 1 showing another embodiment of the present invention.

In the embodiment shown in FIG. 6, the cutter support assembly 58 has three cutters 60 pivotally connected thereto at spaced arcuate intervals therearound, with each of the cutters 60 extending through associated slots 130 in the protective sleeve 126. In addition, each of the cutters 60 is provided with wedge-type teeth 106 and 108 removably connected thereto via tooth holders 124 of conventional construction. It has been determined that the configuration shown in FIG. 6 is particularly efficient for excavating embankments of soil or the like.

Each of the earth containment extensions 46 and 48 includes a vertical guide plate 132 pivotally connected along one edge 134 thereof to the cutting side 24 of the frame 12, each vertically above and on a respective side of the receiving end 28 of the conveyor assembly 26;

and a hydraulic actuated lever arm assembly 136 for pivoting the guide plate 132 between a storage position 138 and an operating position 140 (see FIG. 2). The earth containment extensions 46 and 48 are constructed substantially the same as the vertical earth removal assemblies shown and described in great detail in U.S. Pat. No. 3,778,912, except that the vertical digging implements provided on the vertical earth removal assemblies of the excavator shown in U.S. Pat. No. 3,778,912, are replaced by extension plates 142 (see FIG. 2). Preferably, the extension plates 142 are generally triangular in shape and are sized so that in the operating position 140, the outer edges 144 thereof are substantially co-planer with the cutting plane defined by the movement of the vertical earth removal assembly 44 transversely along the adjacent embankment. Thus, as will be clear to those skilled in the art, the earth containment extension 46 and 48 cooperate with the horizontal earth removal assembly 42 to contain the particulate material dislodged from the adjacent embankment by the horizontal and vertical earth removal assemblies 42 and 44, respectively, so that the particulate material is deposited on the receiving portion 28 of the conveyor assembly 26 for movement toward the discharge portion 30 thereof.

Changes may be made in the construction and the arrangement of the parts or elements comprising the various embodiments disclosed herein without departing from the spirit and scope of the invention as defined in the following claims.

What is claimed is:

1. In a sidebank excavator movable in a first transverse direction along and adjacent to an embankment and in a second transverse direction substantially opposite to the first transverse direction, the excavator having a conveyor assembly for conveying particulate material deposited on a receiving portion thereof to a discharge portion thereof remote from the receiving portion, the improvement comprising:

an elongated cutter support assembly having a lower end connected to the excavator adjacent to the receiving portion of the conveyor assembly for rotation about the longitudinal axis of the cutter support assembly, and an upper end connected to the excavator with the longitudinal axis of the cutter support assembly extending upwardly from the lower end thereof;

means for rotating the cutter support assembly about the longitudinal axis thereof in a selected one of a first rotary direction and a second rotary direction substantially opposite to the first rotary direction;

a cutter having an inner end pivotally connected to the periphery of the cutter support assembly and an outer end disposed radially outwardly of the inner end thereof relative to the axis of the cutter support assembly, the cutter having an earth engaging portion extending generally outwardly from the outer end thereof relative to the axis of the cutter support assembly with a first tooth extending generally orthogonal to the axes of the cutter and the cutter support assembly generally in the first rotary direction, and a second tooth extending generally orthogonal to the axis of the cutter and the cutter support assembly but substantially opposite to the first tooth, the cutter being rotatable about the inner end thereof in a first pivotal direction to decrease the radial distance between the second tooth and the cutter support assembly relative to the radial distance between the first tooth and the cutter support assembly, and in a second pivotal direction to decrease the radial distance between the first tooth and the cutter support assembly relative to the radial distance between the second tooth and the cutter support assembly; and means for preventing the introduction of particulate material into the pivotal connection between the cutter and the cutter support assembly.

2. The sidebank excavator of claim 1 wherein the cutter is further defined as having a first stop portion extending in the first pivotal direction from the cutter adjacent the inner end thereof to limit the rotation of the cutter in the first pivotal direction to a first predetermined distance, and a second stop portion extending in the second pivotal direction from the cutter adjacent the inner end thereof to limit the rotation of the cutter in the second pivotal direction to a second predetermined distance.

3. The sidebank excavator of claim 1 wherein the first and second teeth are removably connected to the cutter.

4. In a sidebank excavator movable in a first transverse direction along and adjacent to an embankment and in a second transverse direction substantially opposite to the first transverse direction, the excavator having a conveyor assembly for conveying particulate material deposited on a receiving portion thereof to a discharge portion thereof remote from the receiving portion, the improvement comprising:

an elongated cutter support assembly having a lower end connected to the excavator adjacent to the receiving portion of the conveyor assembly for rotation about the longitudinal axis of the cutter support assembly, and an upper end connected to the excavator with the longitudinal axis of the cutter support assembly extending upwardly from the lower end thereof;

means for rotating the cutter support assembly about the longitudinal axis thereof in a selected one of a first rotary direction and a second rotary direction substantially opposite to the first rotary direction;

a cutter having an inner end pivotally connected to the periphery of the cutter support assembly and an outer end disposed radially outwardly of the inner end thereof relative to the axis of the cutter support assembly, the cutter having an earth engaging portion extending generally outwardly from the outer end thereof relative to the axis of the cutter support assembly with a first tooth extending generally orthogonal to the axes of the cutter and the cutter support assembly generally in the first rotary direction, and a second tooth extending generally orthogonal to the axis of the cutter and the cutter support assembly but substantially opposite to the first tooth, the cutter being rotatable about the inner end thereof in a first pivotal direction to decrease the radial distance between the second tooth and the cutter support assembly relative to the radial distance between the first tooth and the cutter support assembly, and in a second pivotal direction to decrease the radial distance between the first tooth and the cutter support assembly relative to the radial distance between the second tooth and the cutter support assembly; and means for preventing the introduction of particulate material into the pivotal connection between the cutter and the cutter support assembly comprising a sleeve disposed coaxially around the cutter support assembly, the cutter being provided with arcuate edges along the medial portion thereof and extending through a rectangular-shaped arcuate slot in the sleeve.

5. The sidebank excavator of claim 4 wherein the cutter is further defined as having a first stop portion extending in the first pivotal direction from the cutter adjacent the inner end thereof to limit the rotation of the cutter in the first pivotal direction to a first predetermined distance, and a second stop portion extending in the second pivotal direction from the cutter adjacent the inner end thereof to limit the rotation of the cutter in the second pivotal direction to a second predetermined distance.

6. The sidebank excavator of claim 4 wherein the first and second teeth are removably connected to the cutter.

* * * * *